United States Patent [19]

Périard et al.

[11] Patent Number: 4,575,430

[45] Date of Patent: Mar. 11, 1986

[54] SEPARATING-AND-LUBRICATING AGENT IN SOLID FORM

[75] Inventors: Jacques Périard, Sins; Alain Cron, Hildisrieden; Francis Fischer, Sins, all of Switzerland

[73] Assignee: Lonza Ltd., Gampel/Valais, Switzerland

[21] Appl. No.: 572,073

[22] Filed: Jan. 19, 1984

[30] Foreign Application Priority Data

Feb. 18, 1983 [CH] Switzerland ..... 934/83

[51] Int. Cl.[4] ..... C10M 141/04

[52] U.S. Cl. ..... 252/12.6; 252/12.2; 252/12.4; 252/12; 252/27; 252/29; 252/49.6; 252/51.5 A; 252/56 R; 252/52 R; 72/42

[58] Field of Search ..... 252/12, 12.2, 12.4, 252/12.6; 72/42

[56] References Cited

U.S. PATENT DOCUMENTS 3,341,454 9/1967 Chor, Jr. et al. ..... 252/22
3,838,048 9/1974 Hedge et al. ..... 252/12
3,908,038 9/1975 Nienart et al. ..... 252/12
4,115,283 9/1978 Needham ..... 252/12
4,357,249 11/1982 Mellor ..... 252/12

OTHER PUBLICATIONS

Vlasov, T. F. et al., "Steel in the U.S.S.R.", (Feb. 1974), pp. 153 and 174.
Chemical Abstracts, vol. 81, (1974), 109708k.
Meleshko, V. I. et al., "Steel in the U.S.S.R.", (Oct. 1979), pp. 515 to 519.

*Primary Examiner*—Jacqueline V. Howard
*Attorney, Agent, or Firm*—Fisher, Christen & Sabol

[57] ABSTRACT

A separating-and-lubricating agent in solid form for warm metal shaping, especially hot-sheet or profile rolling. The softening point of the agent is between 20° and 250° C., the melting point is between 30° and 300° C. and the shore-D-hardness at 200° C. is between 20 and 80. The agent contains at least one thermoplastic polymer and/or copolymer and a lubricant for synthetic substances.

15 Claims, No Drawings

SEPARATING-AND-LUBRICATING AGENT IN SOLID FORM

BACKGROUND OF THE INVENTION

1. Field of the Invention

The invention relates to a separating-and lubricating agent in solid form for warm metal shaping, especially for warm-sheet or profile rolling and for example also a mandrel lubricant in the production of seamless pipes.

2. Prior Art

It is known to use glass lubricants, salt lubricants and laminary lubricants on a graphite basis, or aqueous emulsions with synthetic, surface active agents as separating and lubricating agents for non-cutting metal processing. Except for the laminary lubricants, based upon graphite, all of the other lubricants are not useable for hot sheet rolling. Glass or glass-like lubricants cannot be used since they can barely be detached from the surface of the process pieces. Salts, as lubricants in the form of aqueous solutions, lead to extensive corrosion on the workpiece and the machines. The use of lubricating and cooling fluids requires an additional apparatus for their cooling and cleaning in order that the fluid can be circulated.

In order to circumvent such disadvantages, which are known to the experts, a solid lubricant in the shape of briquets was described in *Steel in the USSR,* February 1974, pp. 153 and 154, and in *Chemical Abstracts,* Vol. 81, 1974, 109708k. The solid briquet-shaped lubricant, which is based upon graphite, also contains clays and surface-active additives. Such solid lubricant is pressed against the operating rollers of a rolling mill for producing steel by an apparatus, whereby a thin film of lubricant is applied to the operating rollers. The lubricant however still had disadvantages, as enumerated by Meleshko, Tubol'tsev and Adamskii, "Steel in the USSR", October 1979, pp. 515 to 519. According to page 516, lefthand column, it was impossible to obtain a finely-distributed even film of lubricant over the entire width and periphery of the roller by pressing the lubricant briquets thereon. That led to an uneven surface load of the rollers and sheets and to the destabilization of the rolling process.

BROAD DESCRIPTION OF THE INVENTION

An object of the invention is to provide a lubricant which is solid per se and softenable to meltable at elevated temperatures, which does not have the above-mentioned disadvantages of the prior art and which, besides being useable for hot plate and profile rolling, can also be used for other applications, such as, for the lubricating of pins or mandrel bars in the case of the production of seamless pipes on, for example, continuum or pilger trains. Other objects and advantages of the invention are set out herein or are obvious herefrom to one ordinarily skilled in the art.

The objects and advantages of the invention are achieved by the separating-and-lubricating agent of the invention.

The invention involves a separating-and-lubricating agent in solid form for warm metal shaping, especially for hot-sheet or profile rolling. The agent has a softening point which is between 20° and 250° C., a melting point which is between 30° and 300° C. and a shore-D-hardness at 20° C. which is between 20 and 80. The agent contains at least one thermoplastic polymer and/or copolymer and a lubricant for synthetic substances.

Preferably the agent contains a solid lubricant. The agent preferably contains a wetting agent and preferably contains an adhesion agent. Preferably the agent contains two thermoplastic polymers and/or copolymers. Also preferably the agent contains a lubricant for synthetic substances which is a fatty acid, a fat alcohol, a fatty amide, a soap, a wax, a polyethylene wax or silicone oil. The agent preferably contains a softener for the polymers and copolymers and preferably contains a surface modification agent, which most effectively is a silane or titanate. Fibers, such as, polyethylene, polypropylene, polyamide, polyacrylonitrile, polyester fibers, carbon fibers or glass fibers, are preferably used in the agent. The agent preferably contains clay. The solid lubricant is preferably a fluorinated hydrocarbon, effectively a polytetrafluoroethylene, calcium fluoride, boron nitride or molybdenum disulfide acid, and most preferably is graphite.

The polymer and/or copolymer is preferably present in the agent in a quantity of 1 to 90 percent by weight. Preferably the solid lubricant is present in the agent in a quantity of up to 90 percent by weight. Most preferably, in the agent, the polymer and/or copolymer is present in an amount of 30 to 70 percent by weight and the lubricant is present in an amount of 1 to 50 percent by weight.

DETAILED DESCRIPTION OF THE INVENTION

The separating-and-lubricating agent of the invention contains a thermoplastic polymer and/or copolymer and a lubricant for synthetic substances. Other additives can be present, corresponding to the requirements of the separating or lubricating agents. Such additives can be solid lubricants, wetting agents, adhesive agents, surface modification agents, fibers and/or clay.

Effectively, the separating-and-lubricating agent contains two thermoplastic polymers and/or copolymers.

Examples of useful thermoplastic polymers and/or copolymers are polyolefins, vinyl resins, acrylic resins, metacrylic resins, polyesters, polyamides, thermoplastic urethanes, polyoxymethylenes, polyoxyethylene, polyoxypropylene, polycarbonates, polyether imides, polyphenyloxides, polyphenylsulfides, thermoplastic cellulose derivatives and hydrocarbon resins. The thermoplastic polymers and/or copolymers can be used in a quantity of 1 to 90 percent by weight.

Whenever, according to an effective embodiment of the invention, two thermoplastic polymers and/or copolymers are used, then the polymers may have the same molecular structure but different chain lengths. Examples for this feature are polyethylenes, cumaron-indene resins and hydrocarbon resins.

Further suitable mixtures of two different polymers and/or copolymers are, for example, polyethylene with polyisobutylene and polymethylmethacrylates with polymethacrylates. Such polymers are mutually incompatible. A mixture of polymers or copolymers which are classified as being mutually compatible are, for example, polystyrol with 2,6-dimethyl-1,4-phenylene oxide—such mixture has proven to be particularly advantageous.

The separating-and-lubricating agent contains according to the invention a lubricant for synthetic substances. Fatty acids, fatty alcohols, fat amides, soaps, waxes or polyethylene waxes can be used as the lubricant.

The addition of an adhesive agent and/or a softener for the polymers or copolymers improves adhesion on metal surfaces and lowers the softening temperature of the mixture. As a rule these are rosin derivatives, terpene resins, hydrocarbon resins, cumaron-indene-resins and the softeners customarily used in case of thermoplastics, such as are enumerated for example in *Modern Plastic Encyclopedia,* (1983).

The separating-and-lubricating agent moreover advantageously contains a solid lubricant. Polytetrafluoroethylene, calcium fluoride, molybdenum disulfide, boron nitride and especially graphite are suitable solid lubricants. The effect of such lubricant is known.

In order to disperse the solid lubricant in the separating-and-lubricating agent and in order to incease the adhesion of such agent on the metal, a wetting agent can be added. The wetting agent causes a superficial plasticification ["Rehbinder-effect", P. A. Rehbinder and E. D. Scukin, "The Phenomena Of Surface In The Deformation And The Fracture Of Solids", Seminary of the Mechanics of Surfaces, ISMCM-CNRS (1971)] of metals, which leads in the case of friction to low friction coefficients and by smoothing of the surfaces to low, even wear of the friction partners.

For the same reason, a surface modification agent, preferably a silanes or titanates, can be used. Aminopropyltriethoxysilane or isopropyltriisostearyltitanate are examples.

In order to be able to produce molded articles having increased mechanical strength from the separating-and-lubricating agent, it may be of advantage to admix fibers with such agent. Examples of such fibers are polyethylene fibers, propylpropylene fibers, polyamide fibers, polyacrylonitrile fibers, polyester fibers, carbon fibers or glass fibers.

By adding plastic, inorganic raw materials which are clay minerals, such as, kaolins, clays, bentonites, talcium or vermiculite, the plasticity and the friction coefficient of the separating-and-lubricating agent can be influenced.

A separating-and-lubricating agent, for example for hot plate and profile rolling, can have the following quantitative portions of the individual components: 1 to 90 percent by weight of polymer and/or copolymer; 1 to 70 percent by weight of lubricant; up to 90 percent by weight of solid lubricant; up to 10 percent by weight of wetting agent; up to 70 percent by weight of adhesive agent; up to 30 percent by weight of softener; up to 2 percent by weight of surface modification agent; up to 20 percent by weight of clay; and up to 5 percent by weight of fibers. For use as a lubricant for a mandrel, the composition of the separating-and-lubricating agent can be effectively have the following quantitative proportions: 30 to 70 percent by weight of polymer and/or copolymer; 1 to 50 percent by weight of lubricant; 20 to 50 percent by weight of adhesive agent; 10 to 90 percent by weight of solid lubricant; up to 7 percent by weight of wetting agent; up to 2 percent by weight of surface modification agent; and up to 5 percent by weight of fibers.

The mixture of the components of the invention must result in a separating-and-lubricating agent which has a solid form at ambient temperature. Whenever the separating-and-lubricating agent is heated and thereby softened in the case of the application during hot sheet rolling by the contact with a hot roller or in case of the production of seamless pipes by a hot mandrel, a film, which is homogeneous in composition and thickness, can be formed by abrading or melting off on the roller or on the mandrel. Such film, on the one hand, is watertight so that the considerable quantities of cooling water which flow over the rollers or the mandrel to not affect the film. On the other hand, the film may be transferred easily from one roller to another. Thus, for example, it is possible in the case of hot sheet or profile-rolling to apply the separating-and-lubricating agent onto the pressure rollers, when in their turn transfer the separating-and-lubricating agent to the operation rollers, whereby a film (which is homogeneous in composition and thickness) will always be preserved. In the case of use of the separating-and-lubricating agent, especially as a lubricant for mandrels, the solid lubricant makes sure that no excess loads and tensions occur even under these loaded conditions, such as, high pressures, high temperatures and friction between the tool and the workpiece.

The separating-and-lubricating agent is produced by mixing of the components in heat, for example, by a kneader, and molding the individual components into the desired shape. The processing can also be accomplished in an extruder and by injection molding.

The finished elements are solid at ambient temperature and have a softening point of 20° to 250° C. The shore-D-hardness is 20 to 50 for elements having a low softening point and 50 to 80 for elements having a high softening point. The finished elements have a melting point between about 30° and 300° C. and a cold pressure strength of 5 to 500 kg/cm$^2$.

With the separating-and-lubricating agent of the invention, the performance that has to be exerted, for example in order to roll sheets and profiles, drops considerabaly as a result of the well separating and lubricating of the invention agent. The quality of the surface of the processed workpieces is likewise improved and has, for example, a slight roughness. The separating-and-lubricating agent also leads to greater operational safety, since the lubricating effect may be controlled by the choice of the additions and thus too good of a lubricating effect, which leads to sliding sheets, may be avoided.

The thickness of the film can likewise be well controlled and films of a 50 to 200 micron thickness can be applied. Since the agent has a high lubricating output, a thickness of film of averaging 1 to 2 micron in many cases is sufficient. As compared to the known lubricants based on oil, there is no thick smoke, smoke formation and contamination of the environment when the invention agent is used.

By way of summary, the invention involves a separating-and-lubricating agent in solid form for hot metal processing, especially for hot sheet and profile rolling or for the lubrication of mandrel bars in the case of the production of seamless pipes. The solid separating-and-lubricating agent contains essentially a thermoplastic polymer and/or copolymer and a lubricant for synthetic substances. Other additives, such as, solid lubricants, can be present. The softening point of the agent is from 20° to 250° C., the melting point is from 30 to 300° C. and the shore-D-hardness at 20° C. is from 20 to 80.

This invention includes a separating-and-lubricating agent in solid form for warm metal shaping, especially for hot-sheet or profile rolling. The agent contains (a) at least one thermoplastic polymer and/or copolymer, (b) a lubricant for synthetic substances, (c) a wetting agent, (d) an adhesive agent, (e) surface modification agent, (f)

fibers and (g) a solid lubricant. The agent has a softening point of between 30° and 250° C., a melting point of between 30° and 300° C., a shore-D-hardness at 20° C. of between 20 and 80, and a cold pressure strength of between 5 and 500 kg/cm$^2$. The thermoplastic polymer and/or copolymer is present in an amount between 1 and 90 weight percent. The lubricant is present in an amount between 1 and 70 weight percent. The wetting agent is present in an amount between an effective amount and up to 10 weight percent. The adhesive agent is present in an amount between an effective amount and up to 70 weight percent. The surface modification agent is present in an amount between an effective amount and up to 2 weight percent. The fibers are present in an amount between an effective amount and up to 5 weight percent. Also the solid lubricant is present in an amount between an effective amount and up to 90 weight percent.

As used herein, all percentages, ratios, proportions and parts are on a weight basis unless otherwise stated herein or otherwise obvious herefrom to one ordinarily skilled in the art.

In the following examples, the reference numerals identify the ingredients as such:

(1) thermoplastic polymer,
(3) adhesion agent,
(4) lubricant for synthetic substances,
(5) wetting agent on fatty acid base,
(6) surface modification agent,
(7) solid lubricant,
(9) clay.

EXAMPLE 1

The following ingredients were admixed to provide a separating-and-lubricating agent:

| Ingredients | Weight Percent | Reference Numbers |
|---|---|---|
| Graphite (Lonza) | 61 | (7) |
| Polyester resin Vitel PE 200 (Goodyear) | 26 | (1) |
| Softener Santicizer 141 (Monsanto) | 13 | (3 + 4) |

The mixture produced a transfer-film, lubricating at a temperature of 80° to 90° C.

EXAMPLE 2

The following ingredients were admixed to provide a separating-and-lubricating agent:

| Ingredients | Weight Percent | Reference Numbers |
|---|---|---|
| Graphite (Lonza) | 70 | (7) |
| Vinyl resin Butvar B 98 (Monsanto) | 15 | (1) |
| Softener Santicizer 8 (Monsanto) | 15 | (4 + 3) |

The mixture produced a transfer-film, lubricating between 50° and 100° C.

EXAMPLE 3

The following ingredients were admixed to provide a separating-and-lubricating agent:

| Ingredients | Weight Percent | Reference Numbers |
|---|---|---|
| Graphite (Lonza) | 70 | (7) |
| Polyamide Vestamid X 3541 P2 (Huls) | 23.5 | (1) |
| Magnesium stearate (Olefina) | 1 | (4) |
| Clay Veegum Regular (RT Vanderbilt Co.) | 5 | (9) |
| Titanate KRTTS (Kenrich) | 0.5 | (6) |

The mixture produced a transfer-film at a temperature of 100° to 150° C.

EXAMPLE 4

The following ingredients were admixed to provide a separating-and-lubricating agent:

| Ingredients | Weight Percent | Reference Numbers |
|---|---|---|
| Graphite (Lonza) | 78 | (7) |
| Copolymerizate (Styrene-isoprene-styrene), Cariflex 1107 (Shell) | 10 | (1) |
| Cumaran indene resin (VFT) fluid | 10 | (3) |
| Magnesium stearate (Olefina) | 2 | (4) |
| Tenside Antarox DM 970 (Gaf) | 1 | (5) |
| Clay | 7 | (9) |

The mixture produced a transfer-film at a temperature of 50° to 70° C.

What is claimed is:

1. Separating-and-lubricating agent in solid form for warm metal shaping, especially for hot-sheet or profile rolling, comprising an agent containing (a) at least one thermoplastic polymer and/or copolymer, (b) a lubricant for synthetic substances, (c) a wetting agent, (d) an adhesive agent, (e) a surface modification agent, (f) fibers and (g) a solid lubricant, the softening point of said agent being between 30° and 250° C., the melting point of said agent being between 30° and 300° C., the shore-D-hardness of said agent at 20° C. being between 20 and 80, the cold pressure strength of said agent being between 5 and 500 kg/cm$^2$, the thermoplastic polymer and/or copolymer being present in an amount between 1 and 90 weight percent, the lubricant being present in an amount between 1 and 70 weight percent, the wetting agent being present in an amount between an affective amount and up to 10 weight percent, the adhesive agent being present in an amount between an effective amount and up to 70 weight percent, the surface modification agent being present in an amount between an effective amount and up to 2 weight percent, the fibers being present in an amount between an effective amount and up to 5 weight percent and the solid lubricant being present in an amount between an effective amount and up to 90 weight percent.

2. Separating-and-lubricating agent as claimed in claim 1 wherein said agent contains two thermoplastic polymers and/or copolymers.

3. Separating-and-lubricating agent as claimed in claim 1 wherein the lubricant is a lubricant for synthetic substances which is selected from the group consisting of a fatty acid, a fat alcohol, a fatty amide, a soap, a wax, a polyethylene wax and a silicone oil.

4. Separating-and-lubricating agent as claimed in claim 1 wherein said agent contains a softener for the polymers and/or copolymers.

5. Separating-and-lubricating agent as claimed in claim 1 wherein the surface modification agent is a silane or a titanate.

6. Separating-and-lubricating agent as claimed in claim 1 wherein the fibers are selected from the group consisting of polyethylene fibers, polypropylene fibers, polyamide fibers, polyacrylonitrile fibers, polyester fibers, carbon fibers and glass fibers.

7. Separating-and-lubricating agent as claimed in claim 1 wherein said agent contains clay.

8. Separating-and-lubricating agent as claimed in claim 1 wherein the solid lubricant is selected from the group consisting of a fluorinated hydrocarbon, calcium fluoride, boron nitride and molybdenum disulfide acid.

9. Separating-and-lubricating agent as claimed in claim 1 wherein said solid lubricating agent is graphite or polytetrafluoroethylene.

10. Separating-and-lubricating agent as claimed in claim 1 wherein the polymer and/or copolymer is present in a quantity of 30 to 70 percent by weight and the lubricant is present in a quantity of 1 to 50 percent by weight.

11. Separating-and-lubricating agent as claimed in claim 1 wherein said agent contains a solid lubricant, a wetting agent, an adhesive agent, a surface modification agent, a softener for the polymer and/or copolymer, clay and fibers, the polymer and/or copolymer being present in a quantity of 30 to 70 percent by weight, the lubricant being present in a quantity of 1 to 50 percent by weight, the softener being present in an amount between an effective amount and up to 30 weight percent and the clay being present between an effective amount and up to 20 weight percent.

12. Process for lubricating metal surfaces during warm metal shaping of the metal, comprising contacting said metal surfaces before and/or during said warm metal shaping with a separating-and-lubricating agent in solid form, which comprises an agent containing (a) at least one thermoplastic polymer and/or copolymer, (b) a lubricant for synthetic substances, (c) a wetting agent, (d) an adhesive agent, (e) a surface modification agent, (f) fibers and (g) a solid lubricant, the softening point of said agent being between 20° and 250° C., the melting point of said agent being betwen 30° and 300° C. the shore-D-hardness of said agent at 20° C. being between 20 and 80, the cold pressure strength of said agent being between 5 and 500 kg/cm$^2$, the thermoplastic polymer and/or copolymer being present in an amount between 1 and 90 weight percent, the lubricant being present in an amount between 1 and 70 weight percent, the wetting agent being present in an amount between an effective amount and up to 10 weight percent, the adhesive agent being present in an amount between an effective amount and up to 70 weight percent, the surface modification agent being present in an amount between an effective amount and up to 2 weight percent, the fibers being present in an amount between an effective amount and up to 5 weight percent and the solid lubricant being present in an amount between an effective amount and up to 90 weight percent.

13. Process as claimed in claim 12 wherein the warm metal shaping is hot-sheet or profile rolling.

14. Process for lubricating the metal surfaces of pins or mandrel bars during the production of seamless pipes, comprising contacting said metal surfaces before and/or during said production of seamless pipes with a separating-and-lubricating agent in solid form, which comprises an agent containing (a) at least one thermoplastic polymer and/or copolymer, (b) a lubricant for synthetic substances, (c) wetting agent, (d) an adhesive agent, (e) a surface modification agent, (f) fibers and (g) a solid lubricant, the softening point of said agent being between 20° and 250° C., the melting point of said agent being between 30° and 300° C., the shore-D-hardness of said agent at 20° C. being between 20 and 80, the cold pressure strength of said agent being between 5 and 500 kg/cm$^2$, the thermoplastic polymer and/or copolymer being present in an amount between 1 and 90 weight percent, the lubricant being present in an amount between 1 and 70 weight percent, the wetting agent being present in an amount between an effective amount and up to 10 weight percent, the adhesive agent being present in an amount between an effective amount and up to 70 weight percent, the surface modification agent being present in an amount between an effective amount and up to 2 weight percent, the fibers being present in an amount between an effective amount and up to 5 weight percent and the solid lubricant being present in an amount between an effective amount and up to 90 weight percent.

15. Process as claimed in claim 14 wherein the production of seamless pipes is achieved using a continuum train or a pilger train.

* * * * *